United States Patent [19]

Yorisue

[11] 4,441,339

[45] Apr. 10, 1984

[54] TWO-PIECE YARN CARRIERS FOR CIRCULAR KNITTING MACHINES

[75] Inventor: Shozo Yorisue, Kobe, Japan

[73] Assignee: Precision Fukuhara Works, Ltd., Kobe, Japan

[21] Appl. No.: 348,704

[22] Filed: Feb. 16, 1982

[30] Foreign Application Priority Data

Apr. 6, 1981 [JP] Japan ..... 56-049489[U]

[51] Int. Cl.[3] ..... D04B 15/08; D04B 15/54

[52] U.S. Cl. ..... 66/111; 66/141

[58] Field of Search ..... 66/111, 141, 142, 143, 66/144

[56] References Cited

U.S. PATENT DOCUMENTS

| | | | |
|---|---|---|---|
| 254,750 | 3/1882 | White | 66/141 X |
| 431,913 | 7/1890 | Newton et al. | 66/143 |
| 1,137,561 | 4/1915 | Williams | 66/111 X |
| 1,153,742 | 9/1915 | Wildman et al. | 66/111 |
| 2,062,208 | 11/1936 | Coleman | 66/111 X |
| 2,174,544 | 10/1939 | Zieve | 66/111 X |
| 2,796,752 | 6/1957 | Hauberg | 66/111 X |

FOREIGN PATENT DOCUMENTS

| | | | |
|---|---|---|---|
| 37696 | 3/1936 | Netherlands | 66/111 |
| 3912 | of 1884 | United Kingdom | 66/143 |
| 16483 | of 1889 | United Kingdom | 66/144 |
| 2190 | of 1895 | United Kingdom | 66/143 |

*Primary Examiner*—Wm. Carter Reynolds
*Attorney, Agent, or Firm*—Nathan Levin

[57] ABSTRACT

Two-piece yarn carrier for feeding yarn to the circle of cylinder latch needles of multi-feed circular knitting machines, the carriers comprising a yarn guide having a yarn feeding aperture therein and a guard plate secured to the yarn guide, the guard plate overlapping the yarn guide and being interposed between the yarn guide and the circle of needles. The guard plate overlaps and covers the exit end of the yarn feeding aperture to keep needle hooks and latches out of the yarn feeding aperture. The guard plate also returns prematurely closing latches of needles back to their opened position.

10 Claims, 13 Drawing Figures

TWO-PIECE YARN CARRIERS FOR CIRCULAR KNITTING MACHINES

Figure 1:
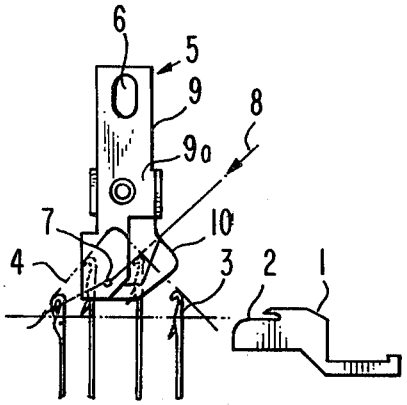

The present invention relates generally to the art of knitting and more particularly to an improvement in yarn carriers for the feeding of yarn to the circle of latch needles at each feed of circular knitting machines.

In the conventional knitting process a yarn carrier feeds yarn to the circle of cylinder latch needles of a multi-feed circular knitting machine where the cylinder needles intersect with dial needles or with sinkers. It is important that the yarn carrier be properly positioned to provide satisfactory yarn feeding to the needles in order to produce high quality fabric regardless of the character or type of fabric being made. The carrier must feed the yarn so that it is sure to be taken by the hooks of the needles and at the same time the yarn feeding aperture of the carrier must be positioned so that the needle hooks and/or the needle latches do not enter the yarn feeding aperture. Adjustments to the carrier are often required for variations in yarn tension, for tight and loose knitting, for tuck stitch formation and for tuck and welt patterning. With the advent of modern high speed knitting, the use of closed track knitting with mono-block cams, shorter latch needles, and ever decreasing space per feed, it happens that knitting adjustments on the machine often require carrier adjustments as well. It is difficult, and requires a high degree of skill on the part of the operator, to accurately position conventional carriers to provide good yarn feeding conditions for the various kinds of knitting and knitting conditions, and at the same time to prevent needle hooks and latches from entering the yarn feeding aperture of the carrier, particularly where there is little room available at each feed of the multi-feed machines. Another problem is the undesirable premature closing of latches when a stitch slips off the end of the needle latches and the latch reacts by moving to closed position.

Accordingly it is the object of the present invention to provide an improved yarn carrier which requires a minimum of adjustment for satisfactory yarn feeding, which prevents entry of hooks and/or latches into its yarn feeding aperture, which can be positioned closer to the cylindrical surface of the needle circle, and which can return prematurely closing latches to their opened position.

The improved carriers are of two-piece construction and comprise a yarn guide having a yarn feeding aperture therein and a guard plate associated with the yarn guide, the guard plate overlapping the yarn guide and being interposed between the yarn guide and the circle of latch needles. The guard plate acts to prevent premature closing of needle latches with a minimum of harm thereto and also acts to prevent entry of hooks and latches of the needles into the yarn feeding aperture. The needle facing side of the yarn guide is undercut to permit passage therethrough of hooks of the circle of needles. The construction of the improved carrier is such that it may be positioned closer to the cylindrical surface of the needle circle for a more desirable feeding relation between the needles and the yarn being fed thereto.

With the above and other objects in view as will become apparent from the accompanying drawings and the description thereof, the invention resides in the improvement in yarn carriers for circular knitting machines as shown and as described, and as set forth in the appended claims.

Figure 2:
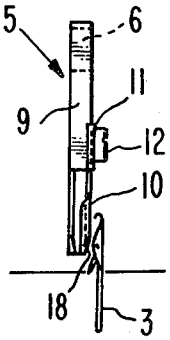
Figure 3:
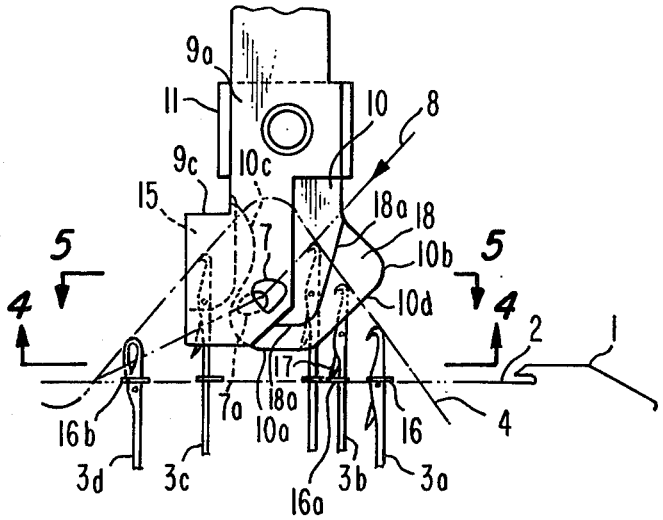
Figure 4:
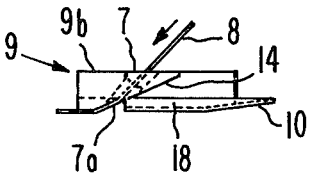
Figure 5:
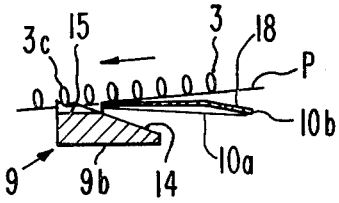
Figure 6:
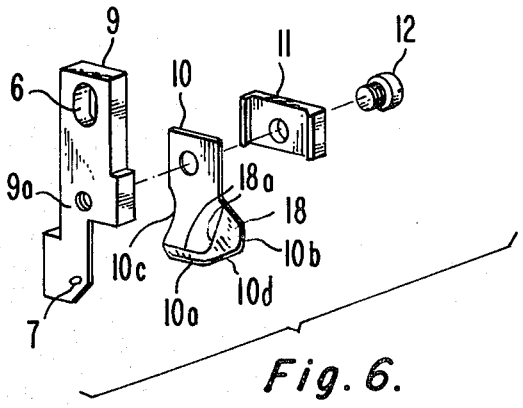
Figure 7:
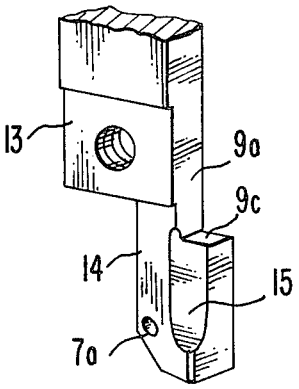
Figure 8:
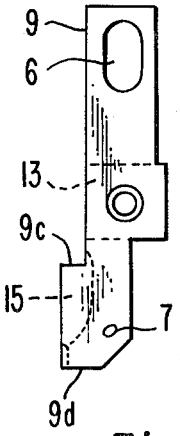
Figure 9:
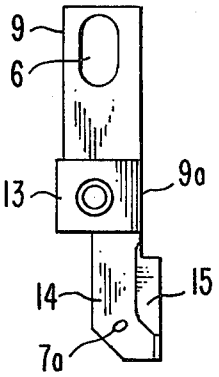
Figure 10:
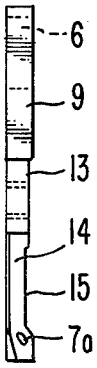
Figure 11:
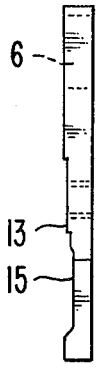
Figure 12:
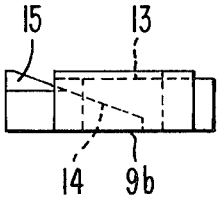
Figure 13:
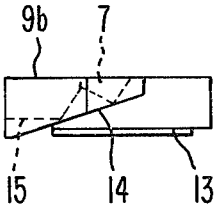

In the drawings:

FIG. 1 is a front elevational view of the two-piece yarn carrier of the present invention as shown in relation to the latch needles and to the yarn fed by the carrier to the needles, the carrier having a yarn guide and a guard plate associated therewith, FIG. 2 is a side elevational view of the carrier shown in FIG. 1, FIG. 3 is an enlarged view of FIG. 1, FIG. 4 is a bottom view of the carrier taken on line 4—4 of FIG. 3, FIG. 5 is a sectional view of the carrier taken on line 5—5 of FIG. 3, FIG. 6 is an exploded view in perspective of the yarn guide, the guard plate, and of the means to fasten the plate to the yarn guide, FIG. 7 is an enlarged view in perspective of the rear or needle side of the yarn guide, FIGS. 8 and 9 are front and rear side elevational views, FIGS. 10 and 11 are right and left side views, and FIGS. 12 and 13 are top and bottom views of the yarn guide itself.

In the drawings, sinkers 1 of a multi-feed circular knitting machine have stitch drawing surfaces 2 over which cylinder needles 3 of the machine draw loops of yarn 8 as the needles follow knitting pathway 4. The yarn is fed to the needles by the two-piece yarn carrier of the present invention which comprises a yarn guide 9 and a guard plate 10 secured thereto. Shank 9*a* of the yarn guide is undercut at 13 on its rear or needle facing side to a depth equal to the thickness of plate 10, the plate being positioned in the undercut and secured to the guide by a U-shaped bracket 11 and a screw 12, FIG. 6, the screw extending through apertures in the bracket and the plate into threaded engagement with the yarn guide. The guide is provided at its upper end with an aperture 6 by means of which the carrier may be secured to the machine and it is also provided at its lower end with a yarn feeding aperture 7 through which yarn 8 is fed to the needles. The lower end of guide 9, in section, FIGS. 4, 5, is in the shape of a right triangle of unequal sides with the hypotenuse thereof forming the rear side 14 of the guide and with the long side of the triangular shape forming the front side 9*b* of the guide. Rear side 14 of the guide faces the needles and is spaced from plate 10. Aperture 7 extends obliquely and downwardly through guide 9 between its opposite faces 9*b* and 14, FIGS. 3, 4, wherein its terminus in surface 14 is indicated by the opening 7*a*. The inner side 14 of guide 9 is undercut at 15 between shoulder 9*c* and a point spaced from the bottom 9*d* of the guide, the undercut being alongside aperture opening 7*a*.

Plate 10, of relatively thin and resilient material, is irregularly shaped and has a bottom portion 10*a* in general alignment with bottom 9*d* of the yarn guide. A projection or horn 10*b* extends from and in continuation of the right hand side of bottom 10*a*, FIGS. 3, 6, and a curved cut out 10*c* extends from and in continuation of the left hand side of bottom 10*a*. Lower edge 10*d* of the horn extends across the knitting path 4 at substantially right angles thereto. A dog leg shaped area 18 of the plate, extending between curved lines 18*a* and the periphery of the plate around horn 10*b* and bottom 10*a*, is angled or flared upwardly along lines 18*a* from the base plane of the plate toward the yarn guide and away from the needle circle, FIGS. 5, 6. Curved cut out 10*c* of plate 10, as shown in dotted line in FIG. 3, overlaps and covers exit 7*a* of feeding aperture 7, the plate being interposed between orifice 7*a* and the needles. Feeding yarn 8 passes between plate 10 and exit 7*a* of aperture 7 in guide 9. Thus the yarn is generally spaced from guard plate 10.

As the needles follow pathway 4, FIG. 3, a needle in position 3*a* is moving upwardly with a previously formed stitch 16 thereon and with its latch in open position. Upon further advance of a needle to position 3*b*, its stitch 16*a* has moved to and is about to drop off the end of latch 17, and when it does, latch 17, free of restraint of stitch 16*a*, may react by moving toward its closed position. Such premature closing of the latch is prevented, and the latch is returned to open position, by guard plate 10 when the latch comes into contact with periphery 10*d* of the horn and into contact with flared surface 18 as the needles move past the carrier. The outwardly flared face of the plate acts as a cam on the latch and eases what would otherwise be a direct blow of the guard plate on the latch.

The carrier, FIG. 5, is positioned so that the guard plate is very close to and is generally tangent to the cylindrical surface P of the needle circle and so that the horn 10*b* of the plate angles away from such cylindrical surface. With the carrier so positioned, the needle hooks, such as the hook of needle 3*c*, FIG. 5, extends part way into cut out 15 on the rear side of the guide. As the needles descend from position of needle 3*c* to position of needle 3*d*, their opened latches are held in open position by yarn 8 as they leave the protection of the yarn guide after which the latches are closed about yarn 8 by previously formed stitch 16*b* as the yarn is taken and formed into new stitches by the descending needles.

While the present yarn carrier is shown and is often referred to as a two-piece yarn carrier in which the yarn guide and the guard plate are each of individual formation, it will be understood, that the yarn guide and the guard plate may be integrally formed.

The concept of the present yarn carrier differs from the prior art in that it is for a combination of a yarn guide which has a yarn feeding aperture into which random ones of the needles accidentally enter as the yarn is being fed to the needles, and of a guard plate related to the needles and to the yarn feeding aperture to prevent such entry of the needles into the aperture. The concept of a guard plate and its function in combination with a yarn feeding aperture of a yarn guide is not shown in the prior art. The guard plate does not interfere with the normal function of the yarn guide and may even be removed from the yarn carrier without interfering with the yarn feeding function of the yarn guide.

I claim:

1. A yarn carrier to feed yarn to the circle of latch needles of a circular knitting machine, the carrier having a yarn guide provided with a yarn feeding aperture through which the yarn is fed to the needles and into which random ones of the needles are adapted to enter as the yarn continues to be fed, and the carrier having a guard plate in addition to the yarn guide, the guard plate being operatively related to the yarn guide and to the needles to prevent entry of the needles into the aperture as the yarn continues to be fed to the needles, the yarn being spaced from the guard plate as it is fed to the needles.

2. A two-piece yarn carrier to feed yarn to the circle of latch needles of a circular knitting machine, one piece of the carrier comprising a yarn guide having a yarn feeding aperture through which the yarn is fed to the needles and into which random ones of the needles are adapted to enter as the yarn continues to be fed, and the other piece of the carrier comprising a guard plate in addition to the yarn guide, the guard plate being operatively related to the yarn guide and to the needles to prevent entry of the needles into the aperture as the yarn continues to be fed to the needles, the yarn being spaced from the guard plate as it is fed to the needles.

3. A yarn carrier as in claim 1 wherein the guard plate is independent of the yarn guide.

4. A yarn carrier as in claim 3 wherein the yarn feeding aperture has an exit end which faces the needles to which the yarn is fed.

5. A yarn carrier as in claim 4 wherein the guard plate is interposed between the needles and the exit end of the yarn feeding aperture.

6. A yarn carrier as in claim 5 wherein the guard plate is spaced from and extends across the exit end of the yarn feeding aperture.

7. A yarn carrier as in claim 5 wherein the guard plate also acts as a latch opener to return closing latches to their opened position.

8. A yarn carrier as in claim 7 wherein the guard plate is disposed in tangential relation to the cylindrical surface of the circle of needles.

9. A yarn carrier as in claim 8 wherein the guard plate extends ahead of the yarn guide in the direction opposite to the direction of travel of the circle of needles relative to the yarn carrier, wherein the guard plate has a leading edge to return closing latches to their opened position, and wherein the guard plate adjacent to its leading edge is flared outwardly of the needle circle.

10. A yarn carrier as in claim 8 wherein the needle side of the yarn guide is undercut adjacent to the yarn feeding aperture to permit passage of the hooks of the circle of needles of which the latches thereof are in opened position as the needles move past the yarn guide to their yarn taking and stitch forming positions.

* * * * *